US005438802A

United States Patent [19]

Johnson

[11] Patent Number: 5,438,802

[45] Date of Patent: Aug. 8, 1995

[54] WEATHERSTRIP ASSEMBLIES

[75] Inventor: Larry E. Johnson, Victor, N.Y.

[73] Assignee: Ultrafab Inc., Farmington, N.Y.

[21] Appl. No.: 52,022

[22] Filed: Apr. 22, 1993

[51] Int. Cl.[6] ..... E06B 7/16

[52] U.S. Cl. ..... 49/489.1; 49/475.1

[58] Field of Search ..... 49/489.1, 493.1, 475.1; 428/96

[56] References Cited

U.S. PATENT DOCUMENTS

| | | | |
|---|---|---|---|
| 2,108,450 | 2/1938 | Schlegel | 49/489.1 |
| 3,175,256 | 3/1965 | Horton | 20/69 |
| 3,224,047 | 12/1965 | Horton | 20/69 |
| 3,266,190 | 8/1966 | Jackson | 49/489 |
| 3,690,038 | 12/1972 | Dieterich | 49/489 |
| 3,819,444 | 6/1974 | Urgerer | 49/489.1 X |
| 3,836,421 | 9/1974 | Terry et al. | 49/489.1 X |
| 4,148,953 | 4/1979 | Horton | 428/85 |
| 4,214,930 | 7/1980 | Burrous | 156/1 |
| 4,458,450 | 7/1984 | Young et al. | 49/489 |
| 4,699,818 | 10/1987 | Evans et al. | 428/96 X |
| 5,093,181 | 3/1992 | Sanchez | 49/489.1 X |
| 5,160,187 | 11/1992 | Drumm | 300/21 |

FOREIGN PATENT DOCUMENTS

| | | | |
|---|---|---|---|
| 39585 | 10/1990 | European Pat. Off. | 49/489.1 |

*Primary Examiner*—Peter M. Cuomo
*Assistant Examiner*—Jerry Redman
*Attorney, Agent, or Firm*—M. Lukacher

[57] ABSTRACT

A weatherstrip assembly has a backing strip 30 with one or more local interference members in the form such as of nubbins 40A or alternative nubbins, which frictionally engage a channel or T-slot holding the backing member 30 and thereby restrict movement of the backing member 30 within the channel or T-slot, and especially movement of the weatherstrip along (longitudinally of) the length of the channel. Lateral (side to side) movement of weatherstrip is also restricted.

17 Claims, 3 Drawing Sheets

FIG. 6
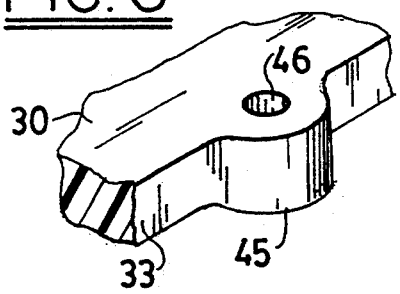
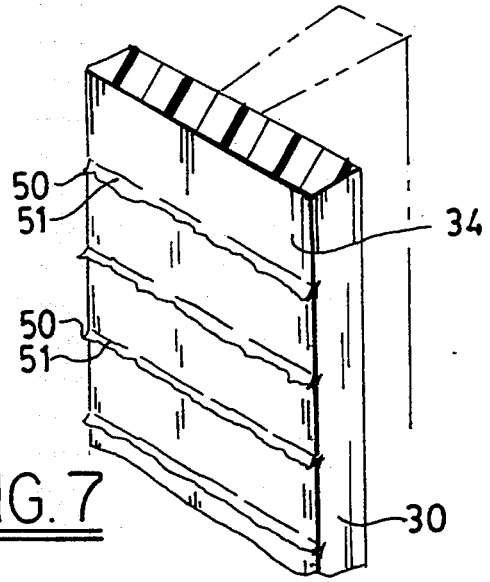
FIG. 7
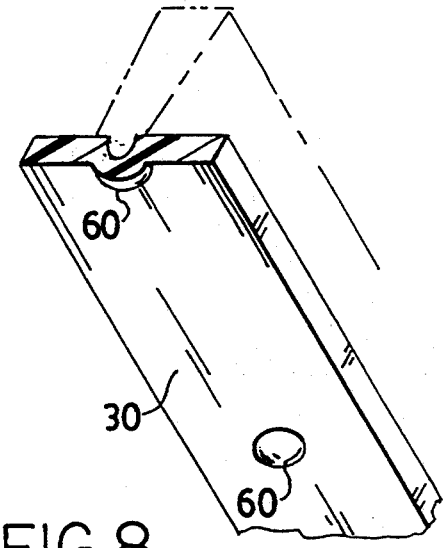
FIG. 8
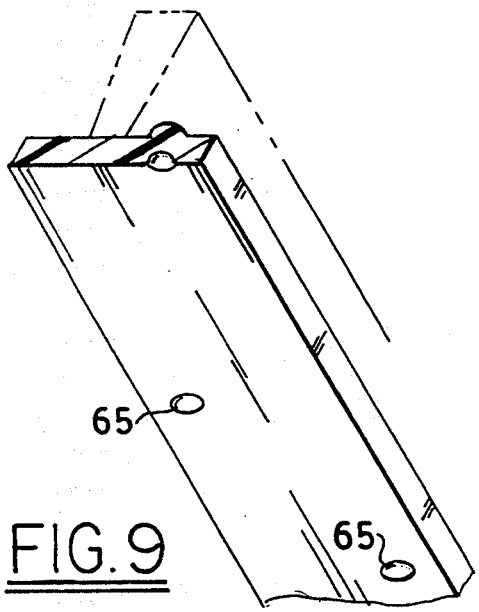
FIG. 9
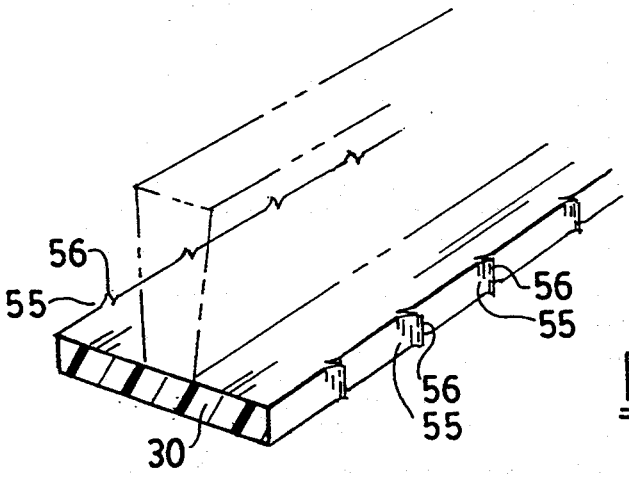
FIG. 10

FIG. 11
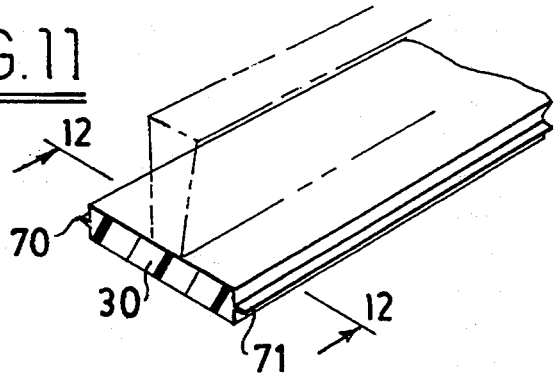
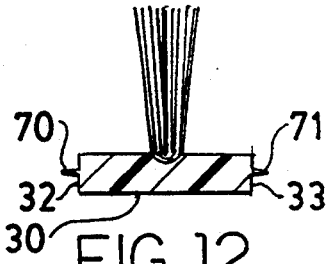
FIG. 12
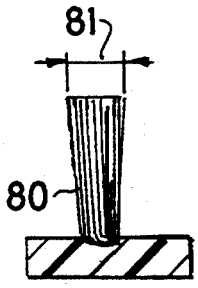
FIG. 13
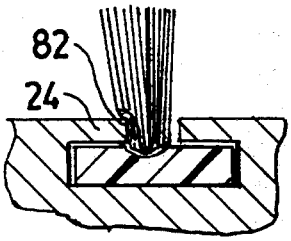
FIG. 14
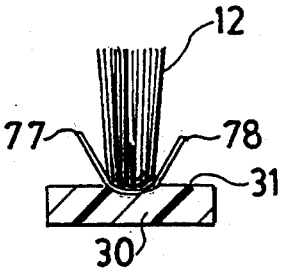
FIG. 15
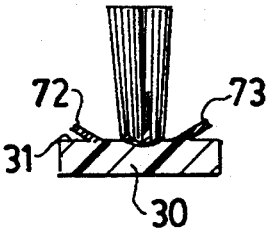
FIG. 16
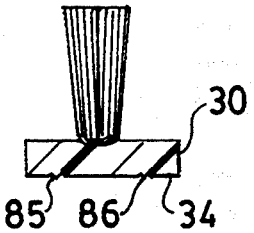
FIG. 17
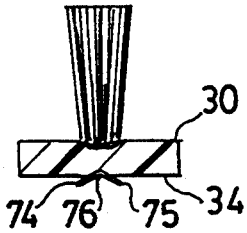
FIG. 18

WEATHERSTRIP ASSEMBLIES

BACKGROUND OF THE INVENTION

The present invention relates to weatherstrip assemblies, and, in particular, to weatherstrip assemblies which are used on windows and doors or other sash members.

The invention is suitable for use with prime windows or doors as well as storm windows and storm doors. Those skilled in the art will appreciate that the invention is useful for other weatherstripping purposes.

Weatherstripping acts as a barrier or seal against the elements and prevents wind, rain and other elements from passing into a structure. This prevention is achieved through the use of an impervious barrier in the weatherstrip. A typical approach to solving problem of mounting a weatherstrip on a window or door structure has been to provide a channel in the periphery of the structure and an insertable strip that is retained in the channel. Early examples of such strip and channel combinations are shown in U.S. Pat. Nos. 3,224,047 and 3,226,190. More recent attempts at solving this problem have relied upon a flexible weatherstrip that can be deformed in order to insert it into a channel defined by relatively rigid structural members. So, for example, in U.S. Pat. No. 3,690,038, there is a shown weatherstrip member C with a cavity D. The weatherstrip member C is of flexible material and flanges 18 and 20 can be manipulated to temporarily reduce the size of the cavity D so that the weatherstrip member C may be inserted into a slot 10. Still others have provided lines of weakness along the backing strip member which can also assist in temporarily deforming the flexible weatherstrip or insertion into a T-slot. See, for example, U.S. Pat. No. 4,458,450.

However, such prior art assemblies do not provide efficient means for laterally restraining the backing member against movement within the T-slot. As such, the backing member is often free to move within the T-slot. Such motion may cause the backing member to gradually work its way out of the T-slot. The weatherstrip is then released thereby eliminating the barrier to the weather elements and thus defeating the whole purpose of the weatherstrip assembly.

SUMMARY OF THE INVENTION

It is a feature of this invention to provide an improved weatherstrip which restrains the motion of the backing strip thereby restoring movement of the weatherstrip.

It is a further feature of this invention to provide a weatherstrip assembly with a backing strip having one or more interference members that engage internal surface portions of the T-slot channel in order to restrict the longitudinal movement of the backing strip within the channel.

It is still another object of this invention to provide a backing strip with surface interference features that locally increase the external dimensions of the backing strip to thereby frictionally engage internal surface portions of the T-slot and thereby restrict the longitudinal movement of the backing strip within the T-slot.

It is another feature of this invention to provide an improved weatherstrip with discrete interference members which provide the desired result of retaining movement of the weatherstrip and to provide various equivalent or alternative means for obtaining that result, including nubbins, distortions, coined surfaces, fins, and extra wide pile fibers for locally interfering with portions of the T-slot and thereby restraining movement of the backing strip within the T-slot.

The movement of the weatherstrip which is restrained is primarily in a longitudinal direction, along the length of the slot, but lateral (side-to-side) movement is also restrained.

DESCRIPTION OF THE DRAWINGS

FIGS. 6–18 illustrate alternative embodiments of the invention.

DETAILED DESCRIPTION

Figure 1:
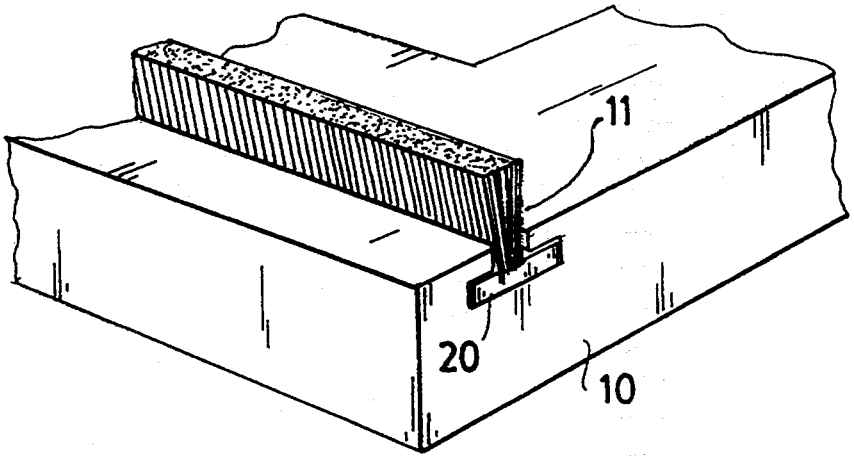
FIG. 1 PRIOR ART
FIG. 1 is a partial perspective illustration of a weatherstrip of the prior art disposed in a T-slot channel of a window or door.
Figure 2:
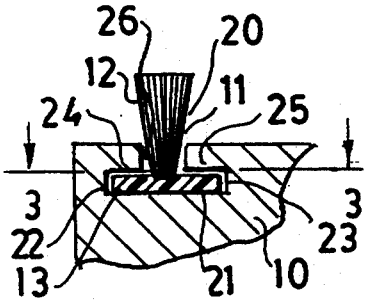
FIG. 2 PRIOR ART
FIG. 2 is a partial cross-sectional area of a prior an weatherstrip assembly.
Figure 3:
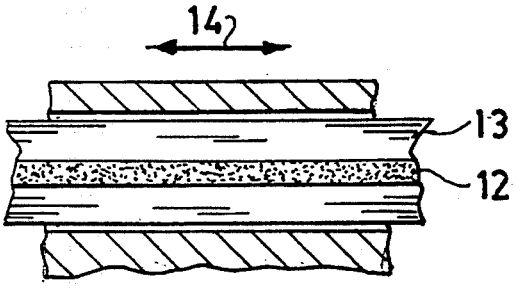
FIG. 3 PRIOR ART
FIG. 3 is a partial top-view taken along plane 3—3 of FIG. 2.

With reference to FIG. 1, there is shown a prior art weatherstrip assembly 11 disposed in a T-slot 20 of a window or door 10. The problems associated with such prior art devices are best understood with reference to FIGS. 2 and 3. There, the T-slot 20 is shown having a base 21, a pair of walls 22, 23 spaced apart by the base 21 and extending vertically therefrom. A pair of lips 24, 25, each extending from one of the opposite walls 22, 23 define an opening 26 in the channel 20. The weatherstrip 11 includes a backing strip 13 and row of pile fibers 12 that extend through the opening 26.

The lips 24, 25 serve to partially extend over the backing strip 13 and thereby retain the weatherstrip 11 and the T-slot 20. However, problems have arisen with such prior art assemblies. One problem is that the weatherstrip 11 may move longitudinally within the T-slot as indicated by the arrows 14. If the weatherstrip is in an open-end channel such as illustrated in FIG. 1, it is possible that the weatherstrip, through vibration or other means including tampering or accident, may ultimately leave the T-slot 20 thereby permitting the intrusion of unwanted environmental elements including heat, cold, wind, rain, dust, etc.

Figure 4:
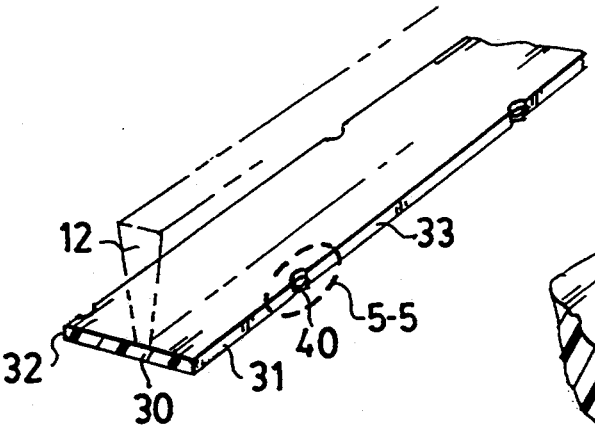
FIG. 4 is a partial perspective view of a weatherstrip member of the invention.
Figure 5:
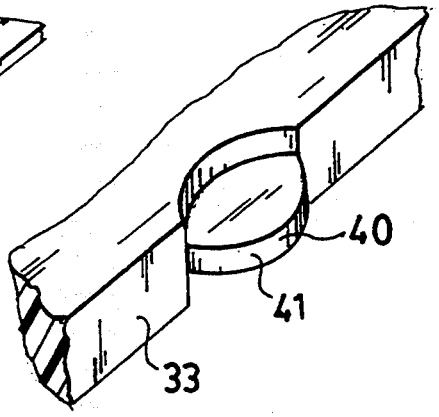
FIG. 5 is an expanded partial perspective view of the area 5—5 of FIG. 4.

The embodiments of the invention shown in FIGS. 4–18 overcome the problems of the prior art by providing a plurality of local interference members that engage one or more surfaces or portions of the T-slot in order to longitudinally restrain the motion of the weatherstrip, and, in particular, the backing strip inside the T-slot. One embodiment of the invention shown in FIGS. 4 and 5 rely upon a plurality of nubbins 40. The backing strip 30 is made of flexible material, see e.g., Horton U.S. Pat. Nos. 3,175,256 and 4,148,953 for fabrication techniques. It has a row of pile fibers 12 longitudinally extending along an upper surface 31. It also has a pair of edges 32, 33. Along the edges there are disposed a plurality of nubbins 40. With reference to FIG. 5, one nubbin 40A is shown in detail. The nubbin is formed by a suitable punching tool that compresses a portion of the material of the backing strip 30 along the edge 33 in order to form a circular, projecting surface 41 along the edge 33. When the backing strip 30 with nubbins 40 are inserted into a T-slot 20, the nubbin surface 41engages the inner surfaces of the sidewall 23 of T-slot 20. This engagement of the sidewalls 22, 23 by the nubbins 40 establishes a restriction or restraint against the unwanted motion 14 within the T-slot 20. Thus, the backing strip 30 of FIG. 4 remains relatively stationary within the T-slot 20. The nubbins are spaced apart sufficiently so that the functional forces are sufficient to restrain longitudinal movement, but not so large as to prevent adjustment and removable for replacement (e.g., about 4" of art Nubbins on opposite sides (edges 32–38) and offset so that a nubbin on one side is between (preferably equal distance from) a pair of spaced nubbins on the opposite side edge of the strip 30.

As an alternate embodiment shown in FIG. 6, the backing strip 30 is provided with a plurality of distortions 45 that project laterally from the edges 32, 33 of the backing strip 30. These distortions 45 also have a circular or curved shape. They are provided by a suitable punch tool that operates on the backing strip 30 to provide a plurality of holes 46 along the edges 32, 33 of backing strip 30. Like the nubbins 40, the distortions 45 frictionally engage the sidewalls 22, 23 of the T-slot 20 and laterally restrain the movement of the backing strip 30 within the T-slot 20.

In another embodiment of the invention depicted in FIGS. 7, 10 the backing strip 30 is laterally restrained by a plurality of abrasions. In FIG. 7, the abrasions 50 are shown extending laterally across the width of the backing strip 30 and on the lower surface 34 thereof. These abrasions are formed by a suitable abrading tool that provides a slight cut in the lower surface 34 of backing strip 30 to provide an interference flaps 51. The abrasion 50 or cut may be formed at any suitable angle. Some abrasions may be formed at different angles in order to provide flaps extending in different directions in order to prevent lateral motion in either direction. The spacing of the abrasions may, like the spacing of the nubbins provide just sufficient frictional force to restrict movement, but not to prevent advertent adjustment or removal of the weatherstrip.

An alternate embodiment of the abrasion technique is shown in FIG. 10. There, the abrasions 55 are shown on the surface of the lateral edges 32, 33 of the backing strip 30 and each has a flap 56 that extends at an angle from edges 32, 33. While the abrasions are all shown as cuts made at the same relative angle, those skilled in the art will appreciate that cuts may be made at different angles in order to provide flaps extending in different angular directions to thereby further restrict lateral motion in both directions within the T-slot 20.

FIGS. 8 and 9 indicate still another form of discrete backing strip surface deformation. In FIG. 8 there is shown a plurality of hemispherically shaped dimples 60. The dimples are shown extending longitudinally along the length of the backing strip 30 in a position generally equalidisinally spaced from the edges 32, 33 thereof. As an alternate embodiment, the dimples may be spaced toward the edges 32, 33 as shown by the dimple 65 in FIG. 9. The dimple may be formed during manufacture of the backing strip 30 through use of a suitable extruding tool. The dimples may also be formed after manufacture by a suitable deformation tool.

Those skilled in the art will understand that the backing strip 30 is generally made of extruded material of a given durometer. Those skilled in the art also understand that materials of different durometers may be combined and simultaneously extruded in order to provide a composite backing strip having portions of different durometers. FIG. 11 shows an example of a backing strip 30 that has a pair of fins 70, 71. The fins 70, 71 are extruded with the backing material 30 but are of a different durometer from the backing strip 30. The fins, 70, 71 are of a softer or more flexible durometer than backing strip 30. As shown in FIGS. 11, 12, the fins 70, 71extend respectively from edges 32, 33 of backing strip 30. The fins 70, 71 provide a sufficient lateral engagement and restraining force against the opposite walls 22, 23 of the T-slot 20 in order to prevent the lateral motion of the backing strip 30 within the T-slot 20.

Other embodiments having of a plurality of fins to bear against portions of the T-slot and restrain the motion of the backing strip 30 are variously shown in FIGS. 15–18. In FIG. 15, a pair of fins 77, 78, preferably of a softer durometer than the backing strip 30 extend horizontally and vertically from the upper surface 31 of the backing strip 30. The fins 77, 78 extend upwardly at an angle and engage the projecting lips 24, 25 of the T-slot 20 and thereby restrain the lateral motion of the backing strip within the T-slot 20. A further feature of the embodiment of the invention in FIG. 15 is that the fin 77, 78 are formed together with the row of pile fibers 12. This assembly of pile fibers 12 and fins 77, 78 are mounted on the backing strip 30. While the fins 77, 78 are indicated as discrete members, those skilled in the art will appreciate that, as shown in FIG. 15, it may be a single member which is suitably contoured to provide upwardly extending ends and a middle suitable for receiving attachment of a row of pile fibers 12.

With references to FIG. 16, a pair of fins 72, 73 are shown integral with the backing strip 30 and extending from the upper surface 31 thereof. They extend laterally and vertically and are designed to engage the lower surface of the projecting lips 24, 25 of the T-slot 20.

FIG. 18 shows still another fin-type embodiment. There, a pair of fins 74, 75 joined at an apex 76 extend laterally and vertically from the lower surface 34 of the backing strip 30. The fins 74, 75 engage the surface of the base 21 of the T-slot 20 thereby restraining the lateral motion of the backing strip 30 within the T-slot 20.

FIG. 17 shows another embodiment of the invention where a pair of coined surfaces 85, 86 are disposed longitudinally along the lower surface 34 of backing strip 30. The coined surfaces 85, 86 engage the surface of the base 21 in order to restrain the motion of the backing strip 30 within the T-slot 20. Of course, in lieu of such coined surfaces, a pair of fins could also be provided along the length of the lower surface 34 to achieve a similar result.

Still another embodiment of the invention is illustrated in FIGS. 13, 14. There, the lateral restraint interference members comprise the row of pile fibers 80 that are made of an extra wide width 81. This row of pile fibers that is made extra wide so that the fibers engage the lips 24, 25 of the T-slot 20 and thereby restrain the motion of the backing strip 30 within the T-slot 20 as a result of the pinching of the wide pile 80 at the point 82 near the base of such row of pile fibers 80.

In all of the embodiments the interference members are spaced or otherwise arranged that movement is restrained, but advertent adjustment and removal of the weatherstrip is allowed.

Having thus described the embodiments of the invention, those skilled in the art will appreciate that further additions, changes, modifications and alterations of the preferred embodiments may be made without departing from the spirit and scope of the appended claims.

What I claim is:

1. A weatherstrip assembly comprising:

a) an elongated channel having a T-shaped cross-sectional area and an internal surface defined by a base and a pair of walls spaced apart from each other and extending vertically from said base and an opening opposite the base;

b) a pair of lips, each lip forming an end of a wall distal from the base and each projecting in a direction toward the other lip to define a reduced cross-sectional area at the opening of said channel;

c) a weatherstrip member comprising an elongated, flexible backing strip disposed in said channel, said backing strip having an upper surface facing said opening and a row of seal forming material extending along said upper surface and extending through said opening, said backing strip comprising an elongated member having a generally rectangular cross-sectional area and external dimensions generally slightly less than said channel; and d) local interference members comprising a plurality of nubbins disposed along said backing strip for engaging the portions of the internal surface of said channel proximate said nubbins to restrict longitudinal movement of the weatherstrip member in the channel, while allowing for advertent movement and removal of the weatherstrip member.

2. The weatherstrip assembly of claim 1 wherein said nubbins are disposed along both edges of said backing strip.

3. The weatherstrip assembly of claim 1 wherein said nubbins comprise a plurality of edge distortions disposed along at least one edge of said backing strip.

4. The weatherstrip assembly of claim 3 wherein said edge distortions are formed by punching holes in said backing strip proximate an edge thereof to distort said strip and cause a portion of said strip to extend beyond the edge thereof.

5. The weatherstrip assembly of claim 3 wherein the edge distortions are disposed along both edges of said backing strip.

6. The weatherstrip assembly of claim 1 wherein said nubbins comprise a plurality of dimples having a hemispherical shape and disposed along the surface of the backing strip facing said base of said channel.

7. The weatherstrip assembly of claim 6 wherein the dimples are reverse cold formed in the backing strip.

8. The weatherstrip assembly of claim 6 wherein the dimples are generally disposed in the center of said backing strip lower surface.

9. The weatherstrip assembly of claim 8 wherein the dimples are generally disposed proximate opposite edges of said lower surface of said backing strip.

10. The weatherstrip assembly of claim 1 wherein said nubbins comprise a plurality of abrasions in said backing strip, said abrasions being principally transverse to said assembly and being formed by partial separations in the surface of said backing strip.

11. The weatherstrip assembly of claim 10 wherein the abrasions extend across the width of the lower surface of said backing strip for engaging the base of said channel.

12. The weatherstrip assembly of claim 10 wherein said abrasions are disposed along one or both edges of said backing strip for engaging one or both walls of said channel.

13. The weatherstrip assembly of claim 1 wherein a lower surface of the backing strip is provided with one or more coined ridges that are raised from and project vertically from said backing strip in order to engage the surface of the base of the T-slot.

14. A weatherstrip assembly comprising:

a) an elongated channel having a T-shaped cross-sectional area and an internal surface defined by a base and a pair of walls spaced apart from each other and extending vertically from said base and an opening opposite the base;

b) a pair of lips, each lip forming an end of a wall distal from the base and each projecting in a direction toward the other lip to define a reduced cross-sectional area at the opening of said channel;

c) a weatherstrip member comprising an elongated, flexible backing strip disposed in said channel, said backing strip having an upper surface facing said opening and a row of seal forming material extending along said upper surface and extending through said opening, said seal forming material being a row of fibrous pile; and d) local interference members comprising the row of pile having a width sufficient to engage the projecting facing edges of the lips and of sufficient thickness to retain the backing strip in the channel and to restrict longitudinal movement of the weatherstrip member in the channel, while allowing for advertent movement and removal of the weatherstrip member.

15. A weatherstrip assembly comprising:

a) an elongated channel having a T-shaped cross-sectional area and an internal surface defined by a base and a pair of walls spaced apart from each other and extending vertically from said base and an opening opposite the base;

b) a pair of lips, each lip forming an end of a wall distal from the base and each projecting in a direction toward the other lip to define a reduced cross-sectional area at the opening of said channel;

c) a weatherstrip member comprising an elongated, flexible backing strip disposed in said channel, said backing strip having an upper surface facing said opening and a row of seal forming material extending along said upper surface and extending through said opening, said seal forming material being a row of fibrous pile; and d) local interference members comprising a pair of fins extending from the surface of the backing strip and engaging the projecting surfaces of the lips to restrict longitudinal movement of the weatherstrip member in the channel, while allowing for advertent movement and removal of the weatherstrip member.

16. The weatherstrip assembly of claim 15 wherein the backing strip is of one durometer and the fins are of a different durometer.

17. The weatherstrip assembly of claim 16 wherein the durometer of the backing strip is harder than the durometer of the fins.

* * * * *